US009895281B1

(12) United States Patent
Sigsworth et al.

(10) Patent No.: US 9,895,281 B1
(45) Date of Patent: Feb. 20, 2018

(54) MOBILITY CHAIR FOR STAIRCASE

(71) Applicants: Joshua Sigsworth, Abington, MA (US); Matthew Gingras, Middletown, CT (US)

(72) Inventors: Joshua Sigsworth, Abington, MA (US); Matthew Gingras, Middletown, CT (US)

( * ) Notice: Subject to any disclaimer, the term of this patent is extended or adjusted under 35 U.S.C. 154(b) by 0 days.

(21) Appl. No.: 15/788,010

(22) Filed: Oct. 19, 2017

(51) Int. Cl.

| | |
|---|---|
| ***A47B 97/00*** | (2006.01) |
| ***A61H 3/00*** | (2006.01) |
| *A61H 3/02* | (2006.01) |
| *A47D 13/04* | (2006.01) |
| *A61H 3/04* | (2006.01) |
| *A45B 3/00* | (2006.01) |

(52) U.S. Cl.
CPC ..... *A61H 3/00* (2013.01); *A45B 3/00* (2013.01); *A47D 13/043* (2013.01); *A61H 3/02* (2013.01); *A61H 3/04* (2013.01); *A61H 2003/001* (2013.01)

(58) Field of Classification Search
CPC ..... A61H 3/04; A47D 13/043; A45B 3/00
USPC ..... 297/463.1, 5, 6; 135/65–67
See application file for complete search history.

(56) References Cited

U.S. PATENT DOCUMENTS 3,455,313 A * 7/1969 King ..... A61H 3/00 135/67
4,094,331 A * 6/1978 Rozsa ..... A61H 3/00 135/67
4,415,198 A * 11/1983 Brearley ..... A61H 3/00 297/440.11
4,452,484 A * 6/1984 Pastor ..... A47D 13/04 135/67
5,443,304 A * 8/1995 Fochs ..... A61H 3/04 135/67
5,787,913 A * 8/1998 Li ..... A61H 3/00 135/67
6,030,039 A * 2/2000 Essler ..... A47C 15/008 128/845
6,145,524 A * 11/2000 Li ..... A61H 3/00 135/67
6,371,142 B1 * 4/2002 Battiston ..... A61H 3/04 135/66
8,667,976 B2 * 3/2014 Huang ..... A61H 3/00 135/67
8,720,914 B1 * 5/2014 Heath ..... A61H 3/04 135/67

(Continued)

*Primary Examiner* — Syed A Islam
(74) *Attorney, Agent, or Firm* — Gulf Coast Intellectual Property Group

(57) ABSTRACT

A mobility chair configured to assist a patient that has a weight bearing restriction on a lower limb traverse a staircase. The mobility chair includes a frame having a pair of front leg members and a pair of rear leg member wherein the frame has an opening on the front end thereof providing patient access to a seat member assembly. A pair of upper horizontal support members and a pair of lower horizontal support members extend intermediate the pair of front leg members and a pair of rear leg members. The seat member assembly is slidably coupled to the pair of lower horizontal support members. A first biasing member and second biasing member are operably coupled to the seat member assembly and provide movement intermediate a first position and a second position wherein in the first position the seat member assembly is proximate the opening of the frame.

18 Claims, 3 Drawing Sheets

(56) References Cited

U.S. PATENT DOCUMENTS

| | | | | |
|---|---|---|---|---|
| 8,936,033 | B2 * | 1/2015 | Velarde | A61H 3/00 135/67 |
| 9,486,383 | B1 * | 11/2016 | Pichnarcik | A61H 3/00 |
| 9,649,523 | B2 * | 5/2017 | Brady | A63B 21/00047 |
| 2011/0232665 | A1 * | 9/2011 | Barnett, Jr. | A45B 7/00 132/200 |
| 2014/0137912 | A1 * | 5/2014 | Kline | A47C 7/008 135/67 |

* cited by examiner

MOBILITY CHAIR FOR STAIRCASE

FIELD OF THE INVENTION

The present invention relates generally to patient mobility apparatus, more specifically but not by way of limitation, a mobility chair for a patient that has conditions such as but not limited to weight bearing restrictions wherein the mobility chair is configured to assist the patient traverse up and down a staircase.

BACKGROUND

Many patients either post surgical or for a particular condition will have weight bearing restrictions placed on them by their health care practitioner. Weight bearing restriction orders can range from the patient not be allowed to place any weight on a limb or be limited as to how much weight and time can be placed on a limb. Patients with these conditions will often undergo physical therapy for an extended period of time. Much of the physical therapy could occur in the patient's home. Various challenges occur when managing a patient who has weight bearing restrictions on a limb once the patient is at home. Typically a patient's home is not configured with various structural elements that may assist in traversing around the interior of the home. Further, a patient's home may have structural elements that present challenges traversing therein such as but not limited to stairs.

Stairs present a unique challenge for patients that have weight bearing restriction orders. These patients may use a variety of devices that assist in movement such as but not limited to crutches or scooters. The aforementioned devices are not capable of effectively helping a patient traverse up or down a staircase. Most homes are not equipped with elevators or stair lifts as these can be quite expensive to install.

Accordingly, there is a need for a mobility assistance device that is configured to assist a user having a weight bearing restriction to traverse up and down a staircase.

SUMMARY OF THE INVENTION

It is the object of the present invention to provide a mobility chair that is configured to assist a user traverse up and down a staircase wherein the mobility chair includes an adjustable frame.

Another object of the present invention is to provide a mobility chair that is operable to assist a patient having a weight bearing restriction traverse a staircase wherein the adjustable frame includes a pair of rear adjustable leg members.

A further object of the present invention is to provide a mobility chair that is configured to assist a user traverse up and down a staircase wherein the adjustable frame further includes a pair of front adjustable leg members.

Still another object of the present invention is to provide a mobility chair that is operable to assist a patient having a weight bearing restriction traverse a staircase wherein the adjustable frame includes lower horizontal support members on opposing sides of the frame.

An additional object of the present invention is to provide a mobility chair that is configured to assist a user traverse up and down a staircase wherein the adjustable frame includes upper horizontal support members.

Yet a further object of the present invention is to provide a mobility chair that is operable to assist a patient having a weight bearing restriction traverse a staircase that further includes a seat member assembly.

Another object of the present invention is to provide a mobility chair that is configured to assist a user traverse up and down a staircase wherein the seat member assembly is slidably coupled to the lower horizontal support members.

An alternate object of the present invention is to provide a mobility chair that is operable to assist a patient having a weight bearing restriction traverse a staircase wherein the seat member assembly includes a pair of biasing members operable to aid in controlling of the position of the seat member intermediate a first position and a second position.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
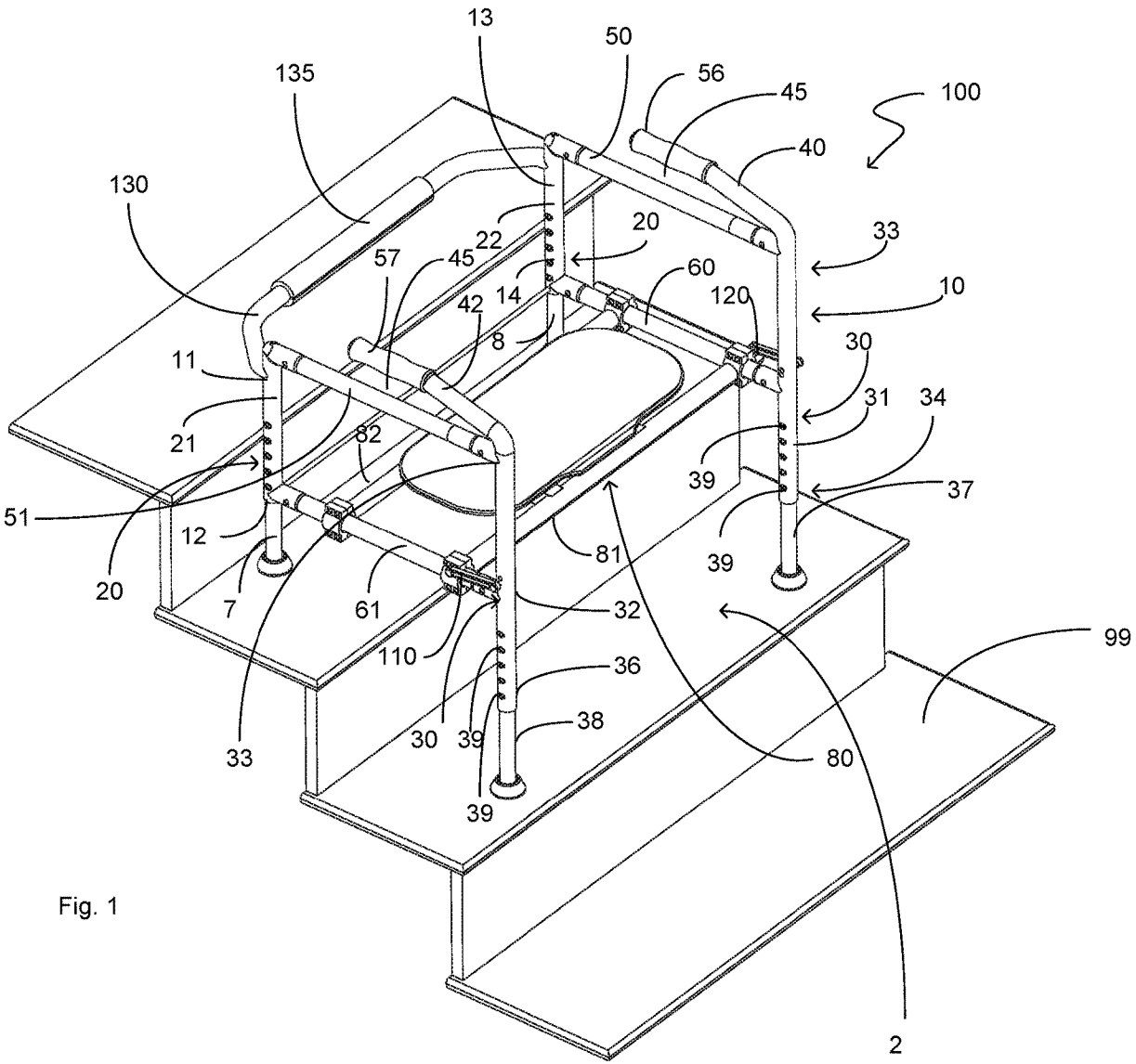
FIG. 1 is a perspective view of the present invention.

Referring now to the drawings submitted herewith, wherein various elements depicted therein are not necessarily drawn to scale and wherein through the views and figures like elements are referenced with identical reference numerals, there is illustrated a mobility chair 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 the mobility chair 100 includes frame 10. The frame 10 is manufactured from a lightweight rigid material such as but not limited to aluminum tubing. The frame 10 is assembled utilizing a combination of suitable techniques that provide adjustment thereof that will be further discussed herein. It is contemplated within the scope of the present invention that the frame 10 could be manufactured in alternate sizes but in its preferred embodiment the frame 10 is manufactured having a depth that provides optimal engagement of the rear leg members 20 and front leg members 30 with adjacent treads of exemplary stairs 99. The frame 10 includes opening 2 providing a patient access thereto.

The frame 10 includes a first front leg member 31 and a second front leg member 32 that are located on opposing sides of the frame 10. The first front leg member 31 includes ends 33,34 and the second front leg member 32 also is similarly constructed having ends 35, 36. Integrally formed with the first front leg member 31 proximate end 33 is first handle member 40. First handle member 40 extends upward and rearward with respect to the frame 10 and is formed with the first front leg member 31 utilizing suitable durable techniques. It is contemplated within the scope of the present invention that the first handle member 40 could be releasably secured to the first front leg member 31 utilizing various conventional fasteners and fastening techniques. A second handle member 42 is present and is constructed similarly to the first handle member 40. The second handle member 42 is integrally formed with the second front leg member 32 proximate end 35. As with the first handle member 40, it is contemplated within the scope of the present invention that the second handle member 42 could be releasably secured to end 35. The first handle member 40 and second handle member 42 extend rearward and are positioned so as to be superposed the upper horizontal support members 50, 51 extending approximately to the midpoint thereof. A void 45 is present intermediate the first handle member 40, second handle member 42 and the upper horizontal support members 50,51 so as to facilitate the ability for a user to surroundably grasp grips 56,57. The positioning of the grips 56, 57 proximate the midpoint of the upper horizontal support members 50 provides the necessary balance during use of the mobility chair 100 so as to inhibit the tipping thereof.

The first front leg member 31 and second front leg member 32 include a plurality of apertures 39 longitudinally disposed thereon. The apertures 39 are configured to receive fasteners (not illustrated herein) so as to operably position the first front leg member extension 37 and second front leg member extension 38. The first front leg member extension 37 and second front leg member extension 38 are configured to provide height alteration of the frame 10 so as to accommodate users of alternate heights and to adjust the mobility chair 100 for alternate riser heights of different staircases. The first front leg member extension 37 and second front leg member extension 38 are slidably coupled with the first front leg member 31 and second front leg member 32 respectively so as to provide a plurality of different height adjustments.

The frame 10 includes a first rear leg member 21 and a second rear leg member 22. The first rear leg member 21 and a second rear leg member 22 are opposite the first front leg member 31 and second front leg member 32 on the frame 10. First rear leg member 21 and a second rear leg member 22 include ends 11,12 and end 13,14 respectively. The length of the first rear leg member 21 and a second rear leg member 22 are less than that of the first front leg member 31 and second front leg member 32 so as to provide parallel engagement of the mobility chair 100 with the exemplary stairs 99. The first rear leg member 21 and the second rear leg member 22 further include a plurality of apertures 17 similar to apertures 39. Slidably coupled to first rear leg member 21 and the second rear leg member 22 are rear extensions 7,8. Similarly to the first front leg member extension 37 and second front leg member extension 38 the extensions 7,8 provide height adjustability of the frame 10 in particular the rear portion thereof so as to accommodate users of alternate heights, stairs of alternate configurations and maintain a parallel orientation of the frame 10 with the exemplary stairs 99. It is contemplated within the scope of the present invention that the extensions 7,8 could be provided in various lengths.

Figure 2:
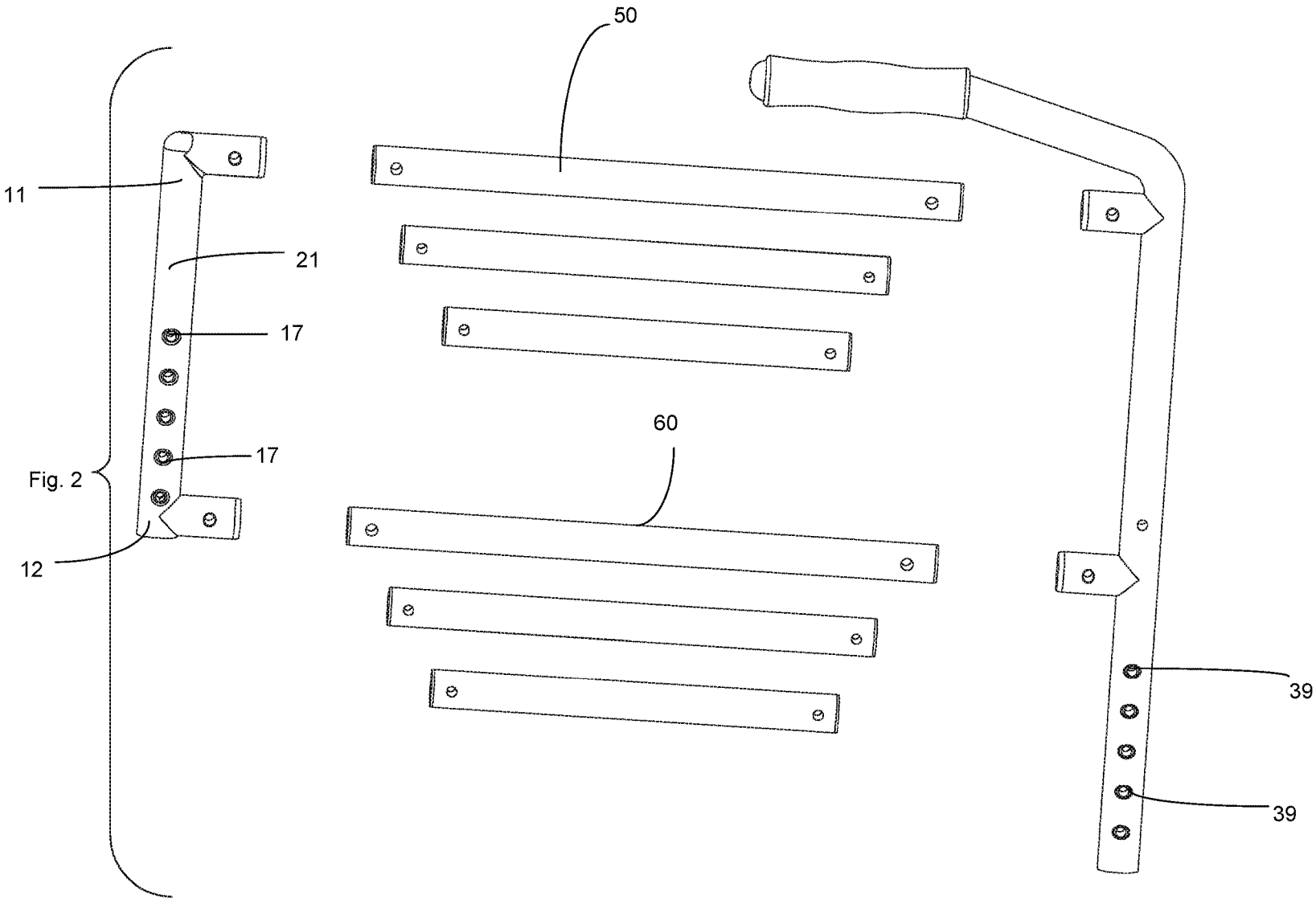
FIG. 2 is a detailed view of the elements of the adjustable frame of the present invention.
Figure 3:
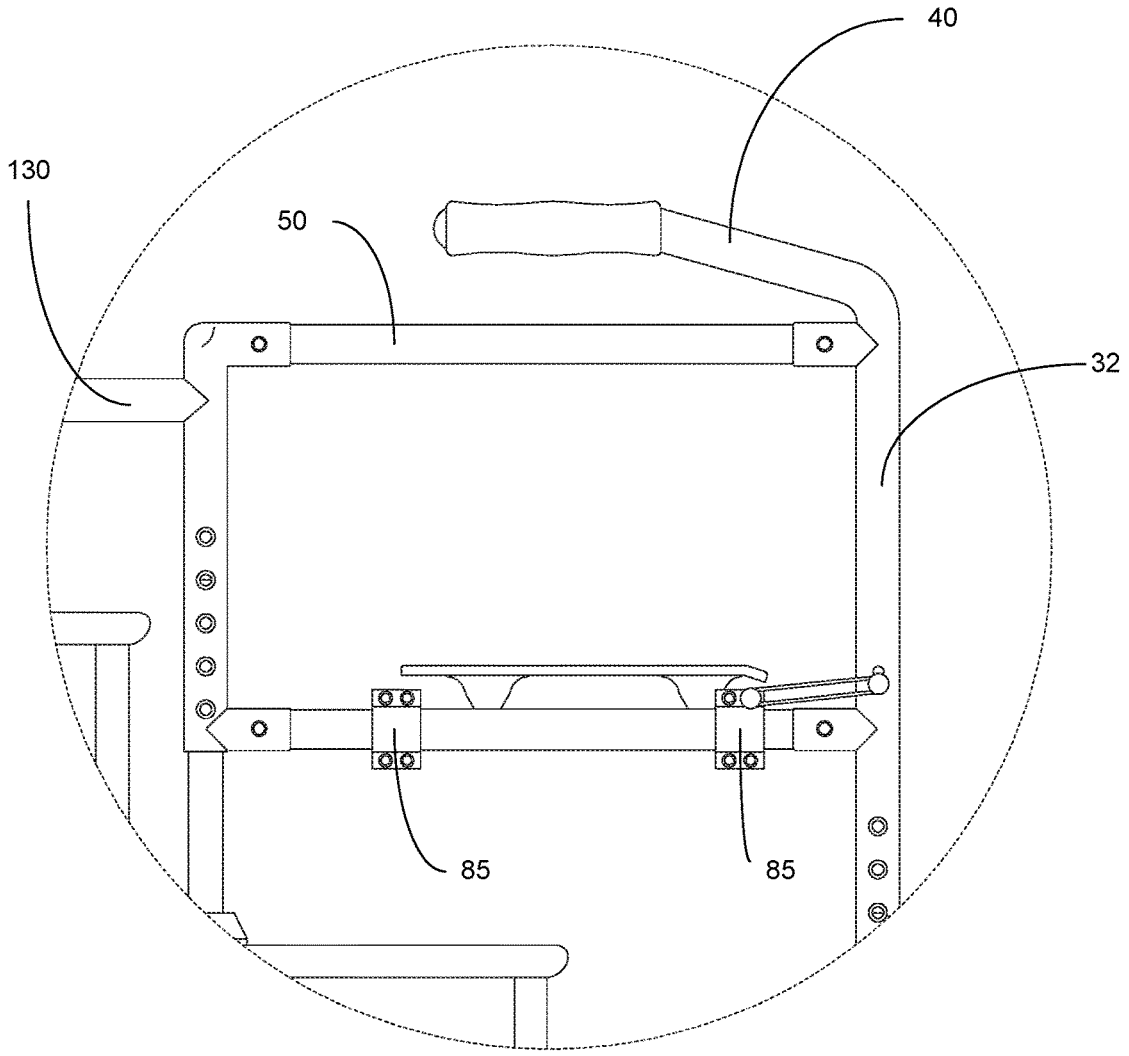
FIG. 3 is a detailed side view of the present invention in use.

Intermediate the rear leg members 20 and front leg members 30 are the upper horizontal support members 50, 51 and the lower horizontal support members 60,61. The upper horizontal support members 50, 51 and the lower horizontal support members 60,61 are operably coupled to the rear leg members 20 and front leg members 30 and perpendicular thereto. As illustrated herein in FIG. 2, the upper horizontal support members 50, 51 and the lower horizontal support members 60,61 could be provided in alternate lengths. The alternate lengths of the upper horizontal support members 50, 51 and the lower horizontal support members 60,61 allow for the mobility chair 100 to have the depth thereof altered in order to more effectively engage exemplary stairs that have varying tread depths. As is known in the art, stairs 99 can have alternate tread depths either as a result of building code or design preference. It is important within the scope of the present invention that the rear leg members 20 and front leg members 30 are positioned such that each can be positioned proximate the midpoint of the tread on adjacent stair steps. While alternate lengths of the upper horizontal support members 50, 51 and the lower horizontal support members 60,61 are provided herein, it is contemplated within the scope of the present invention that the upper horizontal support members 50, 51 and the lower horizontal support members 60,61 could be configured to be adjustable in length so as to deliver the desired objective stated herein.

A seat member assembly 80 is slidably coupled to the lower horizontal support members 60,61. The seat member assembly 80 further includes a first support bar 81 and a second support bar 82. First support bar 81 and second support bar 82 are slidably coupled to the lower horizontal support members 60,61 utilizing couplings 85. Couplings 85 surroundably mounted the lower horizontal support members 60,61 are configured to slidably traverse thereon. Superposed the first support bar 81 and a second support bar 82 is seat 90. Seat 90 is manufactured from a suitable durable material and is manufactured having a size operable to accommodate a user superposed thereon. It should be recognized by those skilled in the art that the seat 90 could be formed in numerous alternate shapes and sizes. Seat 90 is secured to first support bar 81 and a second support bar 82 utilizing suitable durable techniques.

The seat member assembly 80 has operably coupled thereto a first biasing member 110 and a second biasing member 120. The seat member assembly 80 is slidably coupled to the lower horizontal support members 60,61 so as to facilitate optimal positioning of the patient as the patient utilizes the mobility chair 100 to traverse stairs 99. It is important for a patient having a weight bearing restriction on one leg to ensure that their positioning of their leg that is to be used for leverage is ideal so as to avoid injury and successfully traverse the stairs 99. The first biasing member 110 and a second biasing member 120 provide a first position wherein no force is applied to the first biasing member 110 and a second biasing member 120 and the seat member assembly 80 is slightly forward of the center of frame 10. Ensuing a patient engaging the seat member assembly 80 and having begun traversal of the stairs 99, if needed to properly position a foot the first biasing member 110 and a second biasing member 120 allow the slidable movement of the seat member assembly 80. The first biasing member 110 and a second biasing member 120 are manufactured from a resilient material such as but not limited to rubber. As the seat member assembly 80 is transitioned to its second position, the first biasing member 110 and a second biasing member 120 stretch and allow the seat member assembly 80 to be traverse towards the rear leg members 20. In its second position the seat member assembly 80 allows a user to properly position their foot on the stairs 99 ensuring proper engagement therewith so as to avoid potential injuries or an accidental fall. Subsequent the user transitioning to a standing position and moving the mobility chair 100 to the adjacent stair step, the first biasing member 110 and a second biasing member 120 retract so as to place the seat member assembly 80 in a slightly forward position thereby providing an improved position for a user to sit thereon. While the first biasing member 110 and a second biasing member 120 are illustrated and discussed herein as being manufactured from a resilient material such as but not limited to rubber, it is contemplated within the scope of the present invention that the first biasing member 110 and a second biasing member 120 could be constructed from alternate materials and accomplish the desired objective as described herein. It is further contemplated within the scope of the present invention that the mobility chair 100 could have only one biasing member or more than two biasing members to accomplish the desired objective as stated herein.

A back support member 130 is operably coupled to the rear leg members 20 utilizing suitable durable techniques. The back support member 130 is manufactured from suitable materials such as but not limited to aluminum tubing. The back support member 130 extends rearward away from the frame 10. The rearward orientation of the back support member 130 provides additional functionality in the event the mobility chair 100 is tilted rearward excessively during use. In the event of an excessive rearward tilt of the mobility chair 100, the back support member 130 functions to engage a stair so as to prevent the mobility chair 100 from sliding down the staircase. The back support member 130 is operable to ensure a patient's position does not extend past the rear leg members 20 during use of the mobility chair 100. A pad 135 is surroundably mounted to the back support member 130 so as to provide impact force reduction to a user of the mobility chair 100. The pad 135 is manufactured from a suitable material such as but not limited to gel or foam rubber.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mobility chair configured to assist a user in traversing a staircase comprising: a frame, said frame having a first front leg member and a second front leg member, said frame having a first rear leg member and a second rear leg member, said frame further having an upper horizontal support member coupled to said first front leg member and said first rear leg member, said frame having an upper horizontal support member coupled to said second front leg member and said second rear leg member, said frame having a front end and a rear end, said front end being configured with an opening configured to permit a user to access the frame so as to sit on the mobility chair; a first lower horizontal support member and a second lower horizontal support member, said first lower horizontal support member being intermediate said first front leg member and said first rear leg member and operably coupled thereto, said second lower horizontal support member being intermediate said second front leg member and said second rear leg member and being operably coupled thereto; a seat member assembly, said seat member assembly being movably coupled to said first lower horizontal support member and said second lower horizontal support member, said seat member assembly configured to accept a user thereon, said seat member assembly having a first position and a second position; at least one biasing member, said at least one biasing member coupled to said seat member assembly and said frame, said at least one biasing member operable to move said seat member assembly intermediate a first position and a second position, wherein in said first position said seat member assembly is proximate said opening of said frame, wherein in said second position said seat member assembly has been slidably traversed towards said rear end of said frame.

2. The mobility chair as recited in claim 1, wherein said seat member assembly further includes a first support bar and a second support bar wherein said first support bar and said second support bar are parallel.

3. The mobility chair as recited in claim 2, wherein said first front leg member and said second front leg member have a length that is greater than the length of said first rear leg member and said second rear leg member.

4. The mobility chair as recited in claim 3, and further including a first front leg member extension and a second front leg member extension, said first front leg member extension and said second front leg member extension operable to provide height adjustment.

5. The mobility chair as recited in claim 4, and further including a back support member, said back support member being intermediate said first rear leg member and said second rear leg member.

6. A mobility chair that is configured to support a patient and assist in the traversing of a staircase wherein the patient has a physically limiting condition comprising:

a frame, said frame having a first front leg member and a second front leg member, said frame having a first rear leg member and a second rear leg member, said frame further having an upper horizontal support member coupled to said first front leg member and said first rear leg member, said frame having an upper horizontal support member coupled to said second front leg member and said second rear leg member, said frame having a front end and a rear end, said front end being configured with an opening configured to permit a user to access the frame so as to sit on the mobility chair, said first front leg member having a length that is greater than that of said first rear leg member, said second front leg member having a length that is greater than that of said second rear leg member;

a first lower horizontal support member and a second lower horizontal support member, said first lower horizontal support member being intermediate said first front leg member and said first rear leg member and operably coupled thereto, said second lower horizontal support member being intermediate said second front leg member and said second rear leg member and being operably coupled thereto;

a seat member assembly, said seat member assembly being movably coupled to said first lower horizontal support member and said second lower horizontal support member, said seat member assembly configured to accept a user thereon, said seat member assembly having a first position and a second position;

a first biasing member and a second biasing member, said first biasing member and a second biasing member coupled to said seat member assembly and said frame, said first biasing member and a second biasing member operable to move said seat member assembly intermediate a first position and a second position; and wherein in said first position said seat member assembly is proximate said opening of said frame.

7. The mobility chair as recited in claim 6, and further including front leg member extensions, said front leg member extensions being slidably coupled with said first front leg member and said second front leg member, said front leg member extensions configured to adjust the length of said first front leg member and said second front leg member.

8. The mobility chair as recited in claim 7, and further including rear leg member extensions, said rear leg member extensions being slidably coupled with said first rear leg member and said second rear leg member, said rear leg member extensions configured to adjust the length of said first rear leg member and said second rear leg member.

9. The mobility chair as recited in claim 8, wherein said seat member assembly further includes a first support bar and a second support bar wherein said first support bar and said second support bar are parallel, said first support bar and said second support bar being slidably coupled to said first lower horizontal support member and a second lower horizontal support member and perpendicular therewith.

10. The mobility chair as recited in claim 9, wherein in said second position said seat member assembly has been slidably traversed towards said rear end of said frame.

11. The mobility chair as recited in claim 10, wherein said first front leg member and said second front leg member include a plurality of apertures, said plurality of apertures configured to provide positional adjustment of said front leg member extensions.

12. The mobility chair as recited in claim 11, wherein said first rear leg member and said second rear leg member include a plurality of apertures, said plurality of apertures configured to provide positional adjustment of said rear leg member extensions.

13. A mobility chair that is configured to assist a patient that has a physically limiting condition traverse a staircase wherein the mobility chair comprises:

a frame, said frame having a first front leg member and a second front leg member, said frame having a first rear leg member and a second rear leg member, said frame further having an upper horizontal support member coupled to said first front leg member and said first rear leg member, said frame having an upper horizontal support member coupled to said second front leg member and said second rear leg member, said frame having a front end and a rear end, said front end being configured with an opening configured to permit a user to access the frame so as to sit on the mobility chair, said first front leg member having a length that is greater than that of said first rear leg member, said second front leg member having a length that is greater than that of said second rear leg member;

a first lower horizontal support member and a second lower horizontal support member, said first lower horizontal support member being intermediate said first front leg member and said first rear leg member and operably coupled thereto, said second lower horizontal support member being intermediate said second front leg member and said second rear leg member and being operably coupled thereto;

a back support member, said back support member being intermediate said first rear leg member and said second rear leg member;

a seat member assembly, said seat member assembly being movably coupled to said first lower horizontal support member and said second lower horizontal support member, said seat member assembly having a seat configured to accept a user thereon, said seat member assembly having a first position and a second position;

a first biasing member and a second biasing member, said first biasing member and a second biasing member coupled to said seat member assembly and said frame, said first biasing member and a second biasing member operable to move said seat member assembly intermediate a first position and a second position; and wherein in said first position said seat member assembly is proximate said opening of said frame and wherein in said second position said seat member assembly has been slidably traversed towards said rear end of said frame.

14. The mobility chair as recited in claim 13, wherein said seat member assembly further includes a first support bar and a second support bar wherein said first support bar and said second support bar are parallel, said first support bar and said second support bar being slidably coupled to said first lower horizontal support member and a second lower horizontal support member and perpendicular therewith.

15. The mobility chair as recited in claim 14, and further including front leg member extensions, said front leg member extensions being slidably coupled with said first front leg member and said second front leg member, said front leg member extensions configured to adjust the length of said first front leg member and said second front leg member.

16. The mobility chair as recited in claim 15, and further including rear leg member extensions, said rear leg member extensions being slidably coupled with said first rear leg member and said second rear leg member, said rear leg member extensions configured to adjust the length of said first rear leg member and said second rear leg member.

17. The mobility chair as recited in claim 16, and further including a first handle member and a second handle member, said first handle member being contiguous with said first front leg member, said second handle member being contiguous with said second front leg member, said first handle member and said second handle member extending upward and towards said rear of said frame.

18. The mobility chair as recited in claim 17, wherein said first biasing member and said second biasing member are manufactured from rubber.

* * * * *